United States Patent [19]

Binder et al.

[11] Patent Number: 4,513,479

[45] Date of Patent: Apr. 30, 1985

[54] APPARATUS FOR OPENING TEXTILE FIBER BALES

[75] Inventors: Rolf Binder, Räterschen; Daniel Hanselmann, Oberwinterthur; Walter Schlepfer, Winterthur, all of Switzerland

[73] Assignee: Rieter Machine Works Limited, Winterthur, Switzerland

[21] Appl. No.: 621,998

[22] Filed: Jun. 18, 1984

[30] Foreign Application Priority Data

Jun. 24, 1983 [CH] Switzerland ..... 3446/83

[51] Int. Cl.[3] ..... D01G 7/06

[52] U.S. Cl. ..... 19/80 R; 19/81

[58] Field of Search ..... 19/80 R, 81

[56] References Cited

U.S. PATENT DOCUMENTS 3,736,624 6/1973 Alt et al. ..... 19/80 R
4,240,182 12/1980 Leifeld et al. ..... 19/81
4,297,767 11/1981 Leifeld ..... 19/80 R

FOREIGN PATENT DOCUMENTS 0058781 9/1982 European Pat. Off. ..... 19/80 R

*Primary Examiner*—Louis K. Rimrodt
*Attorney, Agent, or Firm*—Werner W. Kleeman

[57] ABSTRACT

To avoid damage to apparatus for opening textile fiber bales by foreign bodies, a fiber diverting member, against an edge of which such foreign bodies strike during opening of the fiber bales, is mounted to be pivotable out of either one of two possible predetermined fiber diverting positions.

10 Claims, 6 Drawing Figures

Fig. 4
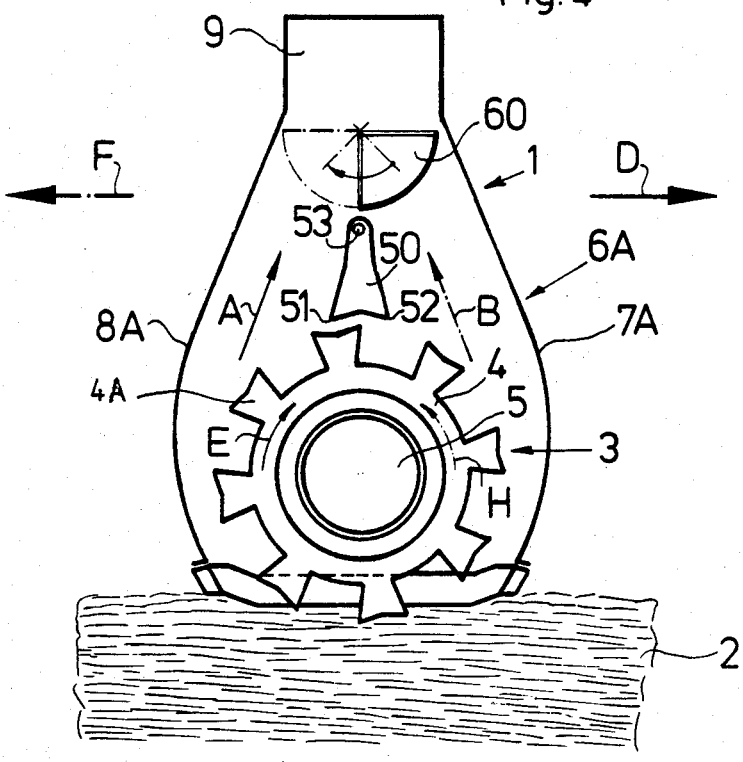
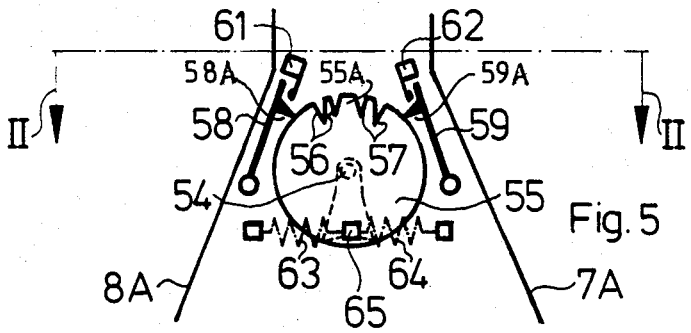
Fig. 5

APPARATUS FOR OPENING TEXTILE FIBER BALES

BACKGROUND OF THE INVENTION

The present invention relates to a new and improved construction of an apparatus for opening of textile fiber bales.

Generally speaking, the apparatus for opening textile fiber bales of the present development is of the type containing a fiber extraction or removal element for extraction of fiber flocks from upper surface layers of a textile fiber bale. There is provided a pneumatic transport duct located above the fiber extraction element for conveying or transporting away the thereto delivered fiber flocks received from the fiber extraction element. A fiber diverting or deflection member extends throughout the entire operable length of the fiber extraction element and is located immediately adjacent thereto in order to guide the fiber flocks delivered from the fiber extraction element into the transport duct.

In practical applications there has become known to the textile art a bale opening apparatus or machine under the trademark "UNIFLOC" which is available from the assignee of the instant application. In that bale opening machine, which is of the type heretofore described, to-and-fro movement of the bale opening machine above the laid-out fiber bales removes fiber flocks from the upper layers of such fiber bales. These removed fiber flocks are then transferred to a pneumatic transporting device also constituting part of the bale opening machine.

A fiber diverting member or means provided immediately above the fiber extraction or removal element, guides the fiber flocks which have been removed from the fiber bales by the fiber extraction or removal element into the pneumatic transporting device.

During practical operation of such equipment it has been found that occasionally undesirable, i.e. disturbing foreign objects or contaminants are present in the fiber bales. These foreign objects are not detected by a metal detector and at the very least can cause disturbances in the fiber extraction or removal elements of the bale opening machine, if not in fact damaging the same.

SUMMARY OF THE INVENTION

Therefore, with the foregoing in mind it is a primary object of the present invention to provide an improved construction of textile fiber bale opening apparatus of the character described which is provided with a facility for avoiding such disturbances and/or damage to the bale opening apparatus.

Another and more specific object of the present invention is concerned with a new and improved construction of an apparatus for opening textile fiber bales, wherein a safety or failsafe structure is provided to ensure than in the event of the presence of undesirable, i.e. disturbing foreign objects or contaminants the bale opening apparatus will be immediately placed out of operation.

Yet a further significant object of the present invention is concerned with a new and improved construction of bale opening machine or apparatus which is relatively simple in construction and design, quite economical to manufacture, extremely reliable in operation, and not readily subject to breakdown or malfunction inasmuch as there is incorporated therein means responsive to the presence of disturbing foreign objects or bodies which, in the presence thereof, triggers stoppage of the bale opening apparatus to prevent disturbance and/or damage thereto.

Now in order to implement these and still further objects of the invention, which will become more readily apparent as the description proceeds, the bale opening apparatus of the present development contains means for mounting the fiber diverting member so that it can be displaced out of the region of the immediate neighborhood of the fiber extraction element in the presence of disturbing foreign objects or bodies.

Through such measures as contemplated by the invention there can not only be avoided damage to the bale opening apparatus, but the disturbing foreign objects or bodies can be removed from the bale opening apparatus with very few manipulations and without encountering any appreciable waste of time.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 4 is a partial schematic sectional view of a modified embodiment of the bale opening apparatus of the invention, the sectional view being taken substantially along the line V—V of FIG. 6;

FIG. 5 is a partial schematic fragmentary end view of the modified construction of bale opening apparatus, as viewed in the direction of the arrow VI of FIG. 6.

DETAILED DESCRIPTION OF THE PREFERRED EMBODIMENTS

Figure 1:
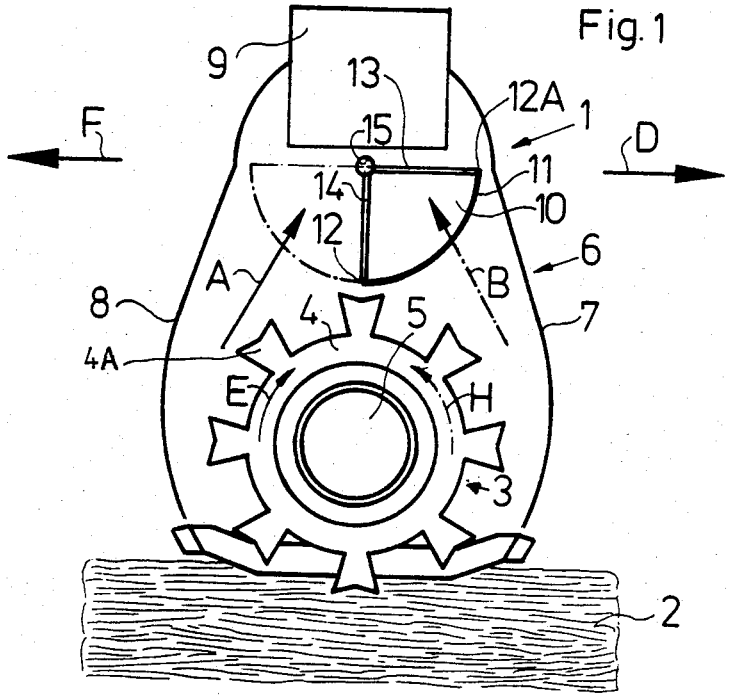
FIG. 1 is a partial schematic sectional view through a first exemplary embodiment of apparatus constructed according to the invention, the section being taken substantially along the line III—III of FIG. 3.
Figure 2:
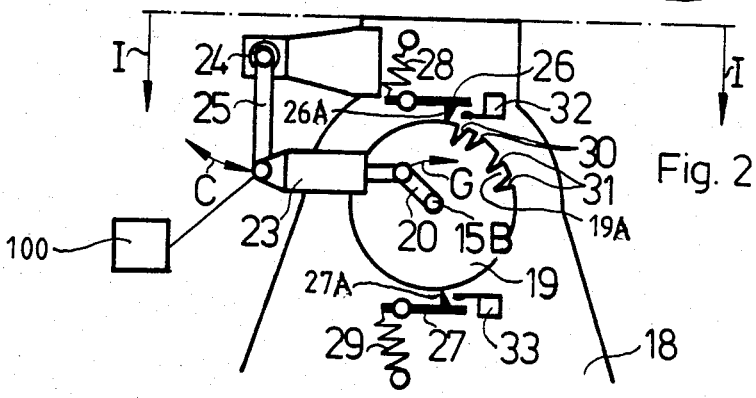
FIG. 2 is a partially schematic fragmentary end view of the apparatus depicted in FIG. 1, as viewed in the direction of the arrow IV of FIG. 3.
Figure 3:
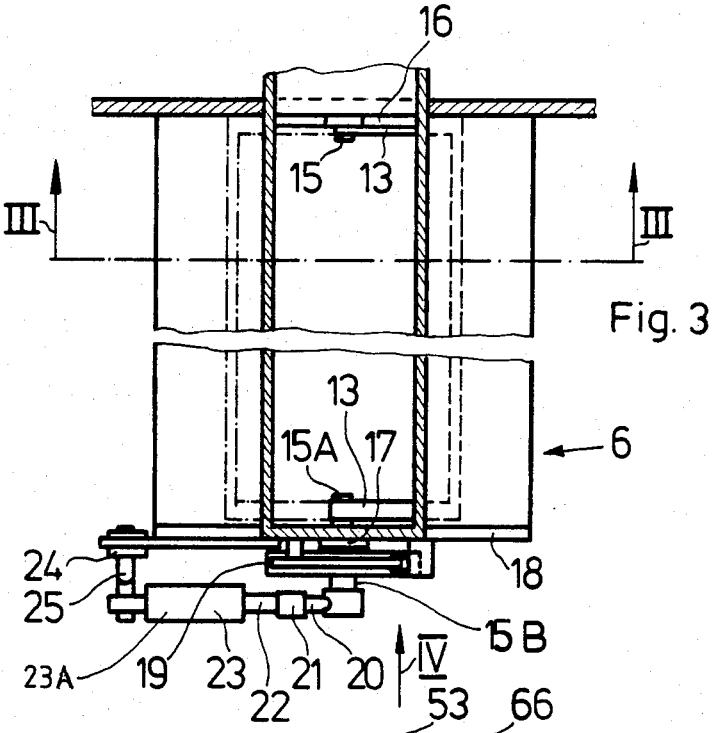
FIG. 3 is a partial schematic plan sectional view of the apparatus depicted in FIGS. 1 and 2, the section being taken substantially along the line I—I of FIG. 2.

Describing now the drawings, it is be understood that only enough of the construction of the bale opening apparatus or machine has been conveniently shown in the drawings as needed for those skilled in the art to readily understand the underlying principles and concepts of the present development, while simplifying the illustration of the drawings. Turning attention now to the first exemplary embodiment of bale opening apparatus 1 for opening textile fiber bales 2, as depicted in FIGS. 1 to 3, it will be seen that such apparatus comprises a fiber extraction or removal element 3, here shown comprising a suitably driven and bi-directionally rotatable shaft 5 provided with toothed or tooth disks 4 containing the teeth 4A. A housing 6 of the bale opening apparatus 1 and containing the housing walls 7 and 8 enclose this fiber extraction or removal element 3 in such a manner that fiber flocks extracted from the upper fiber layers of the fiber bales 2 can be transported, for instance, in the direction of the arrow A into a pneumatic transporting apparatus for the removed fiber flocks, here shown in the form of a pneumatic flock transport or feed duct 9 which is formed by the upper portion of the housing 6.

A fiber diverting or deflection member 10 is arranged immediately above the fiber extraction or removal element 3. This fiber diverting or deflection member 10 is here constructed as a substantially trough-like guide plate 11 which substantially prevents suction of so-called "false air" in the direction, for instance, of the arrow B when fiber flocks are drawn by suction in the direction of the arrow A by means of the pneumatic transport or feed duct 9. When such so-called false air is moving in the direction of the arrow B the bale opening apparatus 1 is moved over the bales 2 in the direction of the arrow D, whereas the fiber extraction element 3 then rotates in the direction of the arrow E of FIG. 1. The fiber flocks are then moved in the direction of the arrow A to the left of the fiber diverting element 10 which assumes the full line position shown at the right-hand portion of such FIG. 1 and blocks the sucking-in of the false air.

Continuing, it will be understood that this guide plate 11 of the fiber diverting or deflection member 10 is formed such that it corresponds essentially to a 90° segment of a circle and, together with the plate edge 12 located, as shown, immediately at and extending along the fiber removal elements constituted by the toothed disks 4, forms a so-called fiber diverting means. The arcuate-shaped guide plate 11 is secured at each of its two opposite ends by means of two respective arms or arm members 13 and 14 to a stub shaft 15 and a further shaft 15A. Consequently such fiber diverting member 10 including the guide plate 11 thereof is selectively pivotable from the position indicated in phantom lines into the position indicated in full lines in FIG. 1 and vice versa. The two arm members 13 located at opposite ends of the guide plate 11 are clearly visible in the showing of FIG. 3, whereas the other two arm members 14, likewise arranged at the opposite ends of the guide plate 11 and extending essentially at right angles to the arm members 13, are not particularly visible in the position of the equipment depicted in FIG. 3. However, one of these arm members 14 is shown in FIG. 1, the other such arm member 14 not being visible therein since it is covered by the depicted arm member 14 since it lies outside of the plane of the showing of FIG. 1. The stub shaft 15 is carried at one end thereof in a support or carrier 16 which is secured to the housing 6, whereas one end of the other shaft 15A is supported in a mounting or bearing 17 secured to the end wall 18 of the housing 6, as best seen by referring to FIG. 3.

A toothed latching or retaining disk 19 and a crank lever 20 are rotatably secured to an outer shaft stub 15B of the shaft 15A. Furthermore, the free end 21 of the crank lever 20 is pivotably secured to the piston or piston structure 22 of an operating or work cylinder 23.

In order to arrange the operating or work cylinder 23 in a stable fixed position for normal operation, but so as to still be pivotable in the direction of the double-headed arrow C in the event of an encountered disturbance, the end 23A of the operating or work cylinder 23 located opposite to the piston or piston structure 22 is pivotably connected to a pivot lever or link 25 secured in a self-centering elastic bearing 24 or equivalent self-centering structure.

Furthermore, two pawls or pawl members 26 and 27, here constituting an upper pawl 26 and a lower pawl 27, are pivotably secured to the housing end wall 18 at the periphery of the toothed latching or retaining disk 19, as particularly shown in FIG. 2. To ensure that these pawls or pawl members 26 and 27 bear against the toothed latching or retaining disk 19, tension springs 28 and 29 or equivalent means are secured to the related pawls 26 and 27, respectively, and likewise to the housing end wall 18, as shown. The toothed latching or retaining disk 19 is provided with recesses or tooth gaps 30 and 31 which form therebetween latching or retaining teeth 19A for receiving therein the pawl tooth means 26A and 27A of the pawl members or pawls 26 and 27, respectively.

Now if during operation of the bale opening apparatus 1 the latter is moved, for instance, in the operating or fiber flock removal direction indicated by the arrow D in FIG. 1 over the prepared or laid-out fiber bales 2, then the fiber diverting or deflection member 10 is located in the full line position depicted in FIG. 1 and the toothed disks 4 rotate in the direction of the arrow E. The thus extracted fiber flocks are then transported in the direction of the arrow A into the pneumatic transport duct 9. Hence, a clean release of the fiber flocks from the toothed disks 4 is ensured by the plate edge 12 and by the entire fiber diverting or deflection member 10.

However if, for instance, a disturbing foreign object or body catches on the teeth 4A of the toothed disk 4 and which has been extracted from the fiber bales 2 and transported towards the plate edge 12 of the fiber diverting member 10, then this fiber diverting or deflection member 10 will be pivoted in the counter-clockwise direction of the showing of FIG. 1. This, in turn, causes the pawl tooth or tooth means 26A of the upper pawl or pawl member 26 to move into one of the two recesses or tooth gaps, indicated by reference character 30 in FIG. 2, whereupon, on the one hand, the pivoted or displaced position of the fiber diverting or deflection member 20 is retained, and, on the other hand, the pawl member 26 acts upon an end or terminal switch 32 which causes rapid stopping of the drive shaft 5 for the toothed disks 4 of the fiber extraction or removal element 3.

After successful removal of the disturbing foreign object or body the pawl member 26 is again withdrawn from the recess 30 with which it previously engaged, so that the fiber diverting member 10 is returned by the action of the self-centering elastic bearing 24 into its operational position shown in full lines in FIG. 1.

If, on the other hand, fiber flocks are removed in the operating direction F, in other words, if the bale opening apparatus 1 is moved in such direction F over the fiber bales 2, then the operating or work cylinder 23 is operated by a suitable control or control means 100 such that the crank lever 20 is pivoted through approximately 90° in the direction of the arrow G of FIG. 2. Consequently, the fiber diverting or deflection member 10 assumes the position depicted in phantom lines in FIG. 1, and the shaft 5 of the fiber extraction element 3 now rotates in the direction of the arrow H. Fiber flocks thus now pass in the direction of the arrow B into the pneumatic transport duct 9 for carrying-away such fiber flocks.

By virtue of the rotation of the toothed latching or retaining latching or retaining disk 19 it will be recognized that the recesses or tooth gaps 30 and 31 are also displaced through one-quarter of a revolution in the direction of the arrow G. Now if in this case a foreign body is entrained by the teeth 4A of the toothed disks 4 and thrown against the plate edge 12A of the guide plate 11 of the fiber diverting member 10, which is in the phantom line position of FIG. 1, then the fiber diverting or deflection member 10 is caused to pivot somewhat upwardly out of the phantom line position of FIG. 1 in the clockwise direction. Hence, the toothed latching or retaining disk 19, in turn, is rotated in the rotational direction indicated by the arrow G and the pawl tooth 27A of the lower pawl member 27 engages into one of the recesses or tooth gaps 31 and such toothed latching or retaining disk 19 is retained or latched in this position. The fiber diverting or deflection member 10 also thus remains in its pivoted position. Upon engagement of the aforementioned pawl tooth 27A in one of the recesses 31 there is now operated an end or terminal switch 33 which likewise causes rapid stopping of the drive shaft 5 for the toothed disks 4 of the fiber extraction or removal element 3.

Here also following successful removal of the undesirable foreign body which caused such stoppage of the bale opening apparatus 1 the pawl tooth 27A of the lower pawl or pawl member 27 is withdrawn from the recess 31 with which it previously engaged, so that the action of the self-centering elastic bearing 24 again causes the fiber diverting or deflection member 10 to move back into its normal operating position depicted in phantom lines at the left-hand side of FIG. 1.

Figure 6:
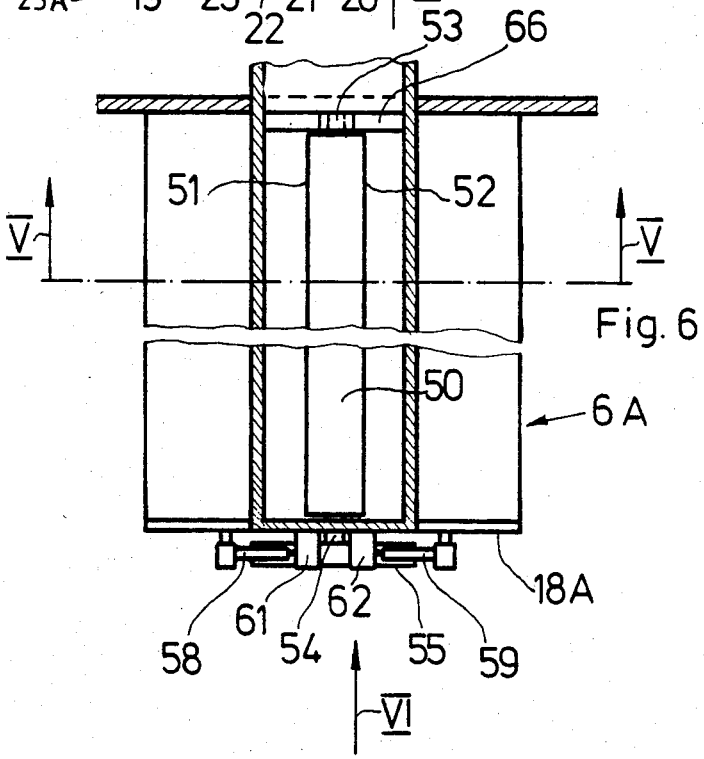
FIG. 6 is a partial schematic plan sectional view of the bale opening apparatus depicted in FIGS. 4 and 5, the section being taken substantially along the line II—II of FIG. 5.

Turning attention now to FIGS. 4, 5 and 6 there is depicted therein a modified construction of the bale opening apparatus, wherein generally there have been conveniently used the same reference characters to denote the same or analogous components. Therefore, as to those parts or components identical to the first embodiment of FIGS. 1 to 3 the same will not be particularly described in detail again.

With the modified construction of bale opening apparatus 1 shown in such FIGS. 4 to 6 there is also provided a fiber diverting or deflection member which, however, here is structured as a fiber-diverting swinging member 50 having two fiber diverting or deflection edges 51 and 52. This fiber-diverting swinging member 50 is pivotably mounted by means of two pivot shafts 53 and 54, as particularly well recognized by inspecting FIGS. 4 and 6. The one shaft 53 is pivotably mounted in a support or carrier 66 fixedly connected in the housing 6A of the bale opening apparatus or machine 1, whereas the other pivot shaft 54 is pivotably mounted in the housing end wall 18A. The fiber diverting edges 51 and 52 of the fiber-diverting swinging member 50 have a length which corresponds to the effective or operable length of the fiber extraction or removal element 3 and project into the immediate neighborhood of the external diameter of the toothed disks 4 which likewise contain the teeth 4A.

Fixedly mounted at the end of the shaft 54 which is located externally of the housing end wall 18A is a toothed latching or retaining disk 55. This latching or retaining disk 55 has recesses or tooth gaps 56, 57 which form therebetween the teeth 55A. There are provided two pawl or pawl members 58 and 59, defining a left-hand pawl 58 and a right-hand pawl 59 in the showing of FIG. 5. Each of these pawl members or pawls 58 and 59 has a pawl tooth or tooth means 58A and 59A which can selectively engage with the tooth gaps or recesses 56, 57. Also it will be observed that the pawl members 58 and 59 are each pivotably mounted in the end wall 18A and each rests with its pawl tooth 58A and 59A on the outer surface or periphery of the toothed retaining or latching disk 55.

Above and directly adjoining the fiber-diverting swinging member 50 is a feed or transport chute 60 which is pivotably mounted in such a manner that it can be selectively pivoted from the position indicated with full lines in FIG. 4 into the position indicated with phantom lines in such FIG. 4. This transport or feed chute 60 is constructed and pivotably mounted in analogous fashion to the fiber diverting or deflection member 10 of the first embodiment of FIGS. 1 to 3 and can be similarly pivoted by means of a crank drive and related operating or work cylinder in the manner previously described with reference to the first embodiment of FIGS. 1 to 3, except that the pivot axis is not resiliently arranged on the cylinder but is fixedly arranged.

Now if during operation of this embodiment of bale opening apparatus 1, the fiber flocks are removed, for instance, in the operating direction D of the apparatus shown in FIG. 4, then the fiber flocks are transported in the direction A into the pneumatic flock transport or feed duct 9. If during such operation of the equipment an undesirable foreign body or object strikes against the fiber diverting edge 51 of the fiber-diverting swinging member 50, then such fiber-diverting swinging member 50 is pivoted in such a manner that the pawl tooth 58A of the pawl member or pawl 58 passes into one of the recesses 56, and thus, on the one hand, there is maintained the pivoted position of the fiber-diverting swinging element, and, on the other hand, there is operated an end or terminal switch 61 which, through the action of any suitable control, ensures for rapid stopping of the drive shaft 5 of the fiber extraction element 3.

Conversely, if fiber flocks are removed from the fiber bales 2 in the opposite direction F, i.e. with the bale opening apparatus 1 of FIG. 4 moving in such operating direction F over the fiber bales 2, and if during such operation an undesirable foreign object or body strikes against the fiber diverting edge 52 of the fiber-diverting swinging member 50, then such fiber-diverting swinging member 50 swings in the opposite direction, so that now pawl tooth 59A of the right-hand pawl or pawl member 59 shown in FIG. 5 engages with one of the recesses 57, and thus again retains the pivoted position of the fiber-diverting swinging member 50. Additionally, such pivotal movement of the pawl 59 into tooth-engaging relationship with the toothed latching disk or retaining 55 causes actuation of an end or terminal switch 62 operatively associated with such pawl member 59, and this again likewise effectuates speedy stoppage of the drive shaft 5 of the fiber extraction element 3.

To avoid undesired displacement of the fiber-diverting swinging member 50 during normal operation without there being present any appreciable foreign bodies which would demand stoppage of the bale opening apparatus, the fiber-diverting swinging member 50 is advantageously provided with a weight which prevents such undesired displacement and/or the latching or retaining disk 55 is retained in such a manner by two compression springs 63 and 64 or equivalent structure that, when the two compression springs 63 and 64 are unloaded, the fiber-diverting swinging member 50 is in a substantially vertical position as indicated in FIG. 4. The retaining or latching disk 55 is not connected with the compression springs, but a cam member 65 rests in a vertical position of the fiber-diverting swinging member 50 freely between the two unloaded compression springs 63 and 64. Instead of using compression springs it would also be possible to employ a rubber buffer or cushioning element or other resilient elements.

Finally, it is here remarked that the housing 6A of the arrangement of FIGS. 4 to 6, in contrast to the housing 6 of the embodiment of FIGS. 1 to 3, has appropriately structured housing walls 7A and 8A configured to accommodate the modified construction of bale opening apparatus 1 of such FIGS. 4 to 6.

While there are shown and described present preferred embodiments of the invention, it is to be distinctly understood that the invention is not limited thereto, but may be otherwise variously embodied and practiced within the scope of the following claims. Accordingly,

What we claim is:

1. In an apparatus for opening textile fiber bales, comprising:

a fiber extraction element for extraction of fiber flocks from upper surface layers of a textile fiber bale;

a pneumatic transport duct arranged above the fiber extraction element for transporting away fiber flocks delivered thereto from the fiber extraction element;

a fiber diverting means extending over the length of the fiber extraction element and immediately adjacent thereto for guiding fiber flocks delivered from the fiber extraction element into the pneumatic transport duct; the improvement which comprises:

means mounting the fiber diverting means for enabling pivoting of said fiber diverting means out of the region in the immediate vicinity of the fiber extraction element when a disturbing foreign object undesirably acts upon the fiber diverting means.

2. The apparatus as defined in claim 1, further including:

means coacting with said mounting means of the fiber diverting means and including an end switch for stopping operation of the fiber extraction element upon pivoting of said fiber diverting means by a disturbing foreign object.

3. The apparatus as defined in claim 2, wherein:

said fiber diverting means comprises a fiber diverting trough-like element.

4. The apparatus as defined in claim 2, wherein:

said fiber diverting means comprises a fiber-diverting swinging element.

5. The apparatus as defined in claim 1, wherein:

said fiber diverting means comprises a fiber diverting trough-like element.

6. The apparatus as defined in claim 1, wherein:

said fiber diverting means comprises a fiber-diverting swinging element.

7. The apparatus as defined in claim 1, wherein:

said fiber extraction element is mounted to be rotatable in opposite rotational directions; and said fiber extraction element is provided with fiber flock extracting means effective in both rotational directions of said fiber extraction element.

8. The apparatus as defined in claim 7, further including:

means for selectively pivoting said fiber diverting means into either one of two operative positions such that said fiber diverting means guides fiber flocks into the pneumatic transport duct in both rotational directions of the fiber extraction element.

9. The apparatus as defined in claim 1, further including:

means for selectively pivoting said fiber diverting means into either one of two operative positions; and latching means for retaining the fiber diverting means, when pivoted out of either one of said operative positions, in the pivoted position into which it has been pivoted by the presence of a disturbing foreign object until subsequent release of said latching means.

10. The apparatus as defined in claim 9, wherein:

said latching means comprises coacting latching elements for holding the fiber diverting means in its pivoted-out position.

* * * * *

UNITED STATES PATENT AND TRADEMARK OFFICE

CERTIFICATE OF CORRECTION

PATENT NO. : 4,513,479

DATED : April 30, 1985

INVENTOR(S) : Rolf Binder et al

It is certified that error appears in the above—identified patent and that said Letters Patent is hereby corrected as shown below:

Column 4, line 44, please delete "20" and insert --10--

Signed and Sealed this

*Sixth* Day of *May 1986*

[SEAL]

*Attest:*

DONALD J. QUIGG

*Attesting Officer*

*Commissioner of Patents and Trademarks*